US007329821B2

(12) United States Patent
Tan

(10) Patent No.: US 7,329,821 B2
(45) Date of Patent: Feb. 12, 2008

(54) SEALED PUSHBUTTON SWITCH

(75) Inventor: Jun-Ming Tan, Shenzhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/516,406

(22) Filed: Sep. 6, 2006

(65) Prior Publication Data

US 2007/0051602 A1 Mar. 8, 2007

(30) Foreign Application Priority Data

Sep. 6, 2005 (CN) ..... 2005 2 00785308

(51) Int. Cl.
*H01H 13/06* (2006.01)

(52) U.S. Cl. ..... 200/302.2; 200/531

(58) Field of Classification Search .... 200/16 R–16 D, 200/520, 530–532, 536, 302.1, 302.2, 329, 200/341, 61.58 R, 61.62, 61.71, 61.73, 61.74, 200/61.76

See application file for complete search history.

(56) References Cited

U.S. PATENT DOCUMENTS 3,946,181 A * 3/1976 Takamizawa et al. ..... 200/531
4,616,112 A * 10/1986 Galloway et al. ..... 200/5 R
5,008,505 A * 4/1991 Takano et al. ..... 200/531
5,463,198 A * 10/1995 Shimaoka ..... 200/531
5,836,442 A * 11/1998 Hirano ..... 200/284
6,396,013 B1 * 5/2002 Kondo ..... 200/302.3
6,459,057 B1 * 10/2002 Domzalski ..... 200/302.2
6,917,003 B2 * 7/2005 Dozono et al. ..... 200/61.44
6,930,261 B2 * 8/2005 Nakade ..... 200/16 D
6,998,556 B1 * 2/2006 Ho ..... 200/531
7,033,662 B2 * 4/2006 Togawa et al. ..... 200/341

* cited by examiner

*Primary Examiner*—Michael A Friedhofer
(74) *Attorney, Agent, or Firm*—Wei Te Chung

(57) ABSTRACT

A sealed pushbutton switch (1) includes an insulative housing (2), a number of fixed contacts (7), an actuator (3) moveably retained in the insulative housing, a moveable contact (6) fastened to the actuator and including a pair of elastic beams (62) each provided with a contact portion (621) contactable to corresponding fixed contacts to establish a reliable electrical connection between the fixed contacts, and a spring (5) mounted below the actuator. When the actuator is pushed, the moveable contact has an agile movement to break the electrical connection between the moveable contact and the fixed contacts.

4 Claims, 7 Drawing Sheets

SEALED PUSHBUTTON SWITCH

BACKGROUND OF THE INVENTION

1. Field of the Invention

The present invention relates to a sealed pushbutton switch, and particularly to a normally closed sealed pushbutton switch used in various electronic appliance.

2. Description of Related Art

A conventional sealed pushbutton switch is described in U.S. Pat. No. 6,459,057, which was issued on Oct. 1, 2002. The pushbutton switch is normally in a closed position, comprising a base, a plurality of fixed contacts assembled to the base, an insulative housing snapping onto the base, an actuator retained in the insulative housing and provided with a shaft and a head, a contact spring normally contactable of an inner edge of fixed contacts for establish an engagement between the contact spring and the fixed contacts, a wire compression spring abutting against a bottom of the head, and an O-ring mounted around the shaft. In operation, the actuator is pushed downwardly to thereby move the contact spring away from the fixed contacts for breaking the electrical connection between the fixed contacts. The pushbutton switch is then caused to be in an electrical opened position.

An electrical connection between the fixed contacts is established by an engagement between the contact spring and inner edges of the fixed contacts. However, the engagement between the contact spring and the fixed contacts is unreliable, not only because an out surface of the contact spring is discrete, but also because the inner edge of the fixed contact is narrow. Further more, the contact spring is moveably retained in the head of the actuator. As a result, the contact spring is hard to be availably driven by the actuator thus is hard to have a steady engagement with the fixed contacts.

Hence, an improved pushbutton switch is required to overcome the above-mentioned disadvantages of the related art.

SUMMARY OF THE INVENTION

A primary object of the present invention is to provide a sealed pushbutton switch having a moveable contact and a fixed contact, between which a reliable engagement is established.

Another object of the present invention is to provide a sealed pushbutton switch formed with a moveable contact having an agile movement during operation.

Another object of the present invention is to provide a sealed pushbutton switch provided with a moveable contact capable of being availably driven by the actuator.

To achieve the aforementioned objects, a sealed pushbutton switch comprises an insulative housing defining a cavity, a plurality of fixed contacts mounted on the insulative housing each formed with an engaging portion, an actuator moveably retained in the insulative housing, a moveable contact fastened to the actuator and comprising a pair of elastic beams each provided with a contact portion contactable to corresponding engaging portions of the fixed contacts, and a spring mounted below the actuator. When the actuator is pressed and moves together with the moveable contact from a first position to a second position relative to the insulative housing along a top-to-bottom direction, an electrical connection between the moveable contact and the fixed contacts comes to break.

The moveable contact comprising a pair of elastic beams each provided with a contact portion would not only get a reliable engagement between itself and the fixed contacts, but also have an agile movement of moving away from the fixed contacts when it is caused to be in electrical opened position.

Additionally, another advantage of the invention is to provide an engaging portion on each fixed contact for enlarging contacting area between the moveable contact and the fixed contact. The engagement between the moveable contact and the fixed contacts is enhanced.

Further more, the moveable contact fastened to the actuator would make itself unmovable relative to the actuator to have a reliable operation together with the actuator. The actuator would have an available manipulation to drive the moveable contact in operation.

Other objects, advantages and novel features of the invention will become more apparent from the following detailed description of a preferred embodiment when taken in conjunction with the accompanying drawings.

DETAILED DESCRIPTION OF THE INVENTION

Figure 1:
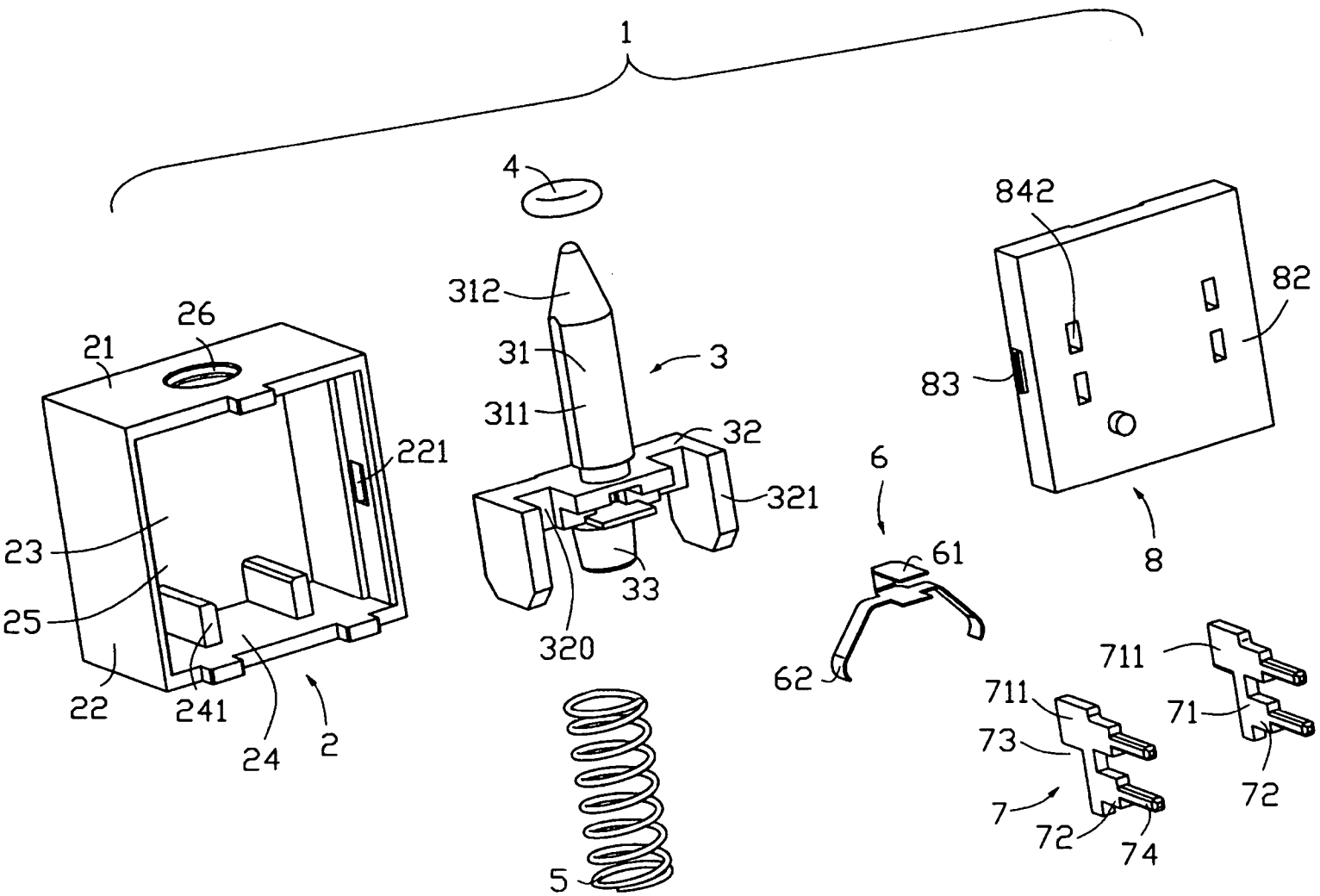
FIG. 1 is an exploded perspective view of a sealed pushbutton switch in accordance with the present invention.

Reference will now be made to the drawing figures to describe the present invention in detail. Referring to FIG. 1, a sealed push button switch 1 in accordance with the preferred embodiment of the present invention comprises an insulative housing 2 defining a cavity 25, an actuator 3 retained in the cavity 25 of the insulative housing 2, a moveable contact 6, a washer 4, a wire compression spring 5 assembled to the actuator 3, a base 8 attached to the insulative housing 2, and a plurality of fixed contacts 7 mounted on the base 8.

Referring to FIG. 1, the insulative housing 2 is a substantially rectangular case, comprising a front wall 23, a top wall 21, a bottom wall 24 opposite to the top wall 21, a pair of side walls 22 extending rearwardly from the front wall 23 to thereby define the cavity 25 therebetween. The top wall 21 has a circular through hole 26 defined in a central portion thereof. Each side wall 22 has a recess 221 defined in an inner surface thereof. A pair of protrusions 241 are symmetrically formed on the bottom wall 24, each with an upmost thereof extending upwardly.

Figure 2:
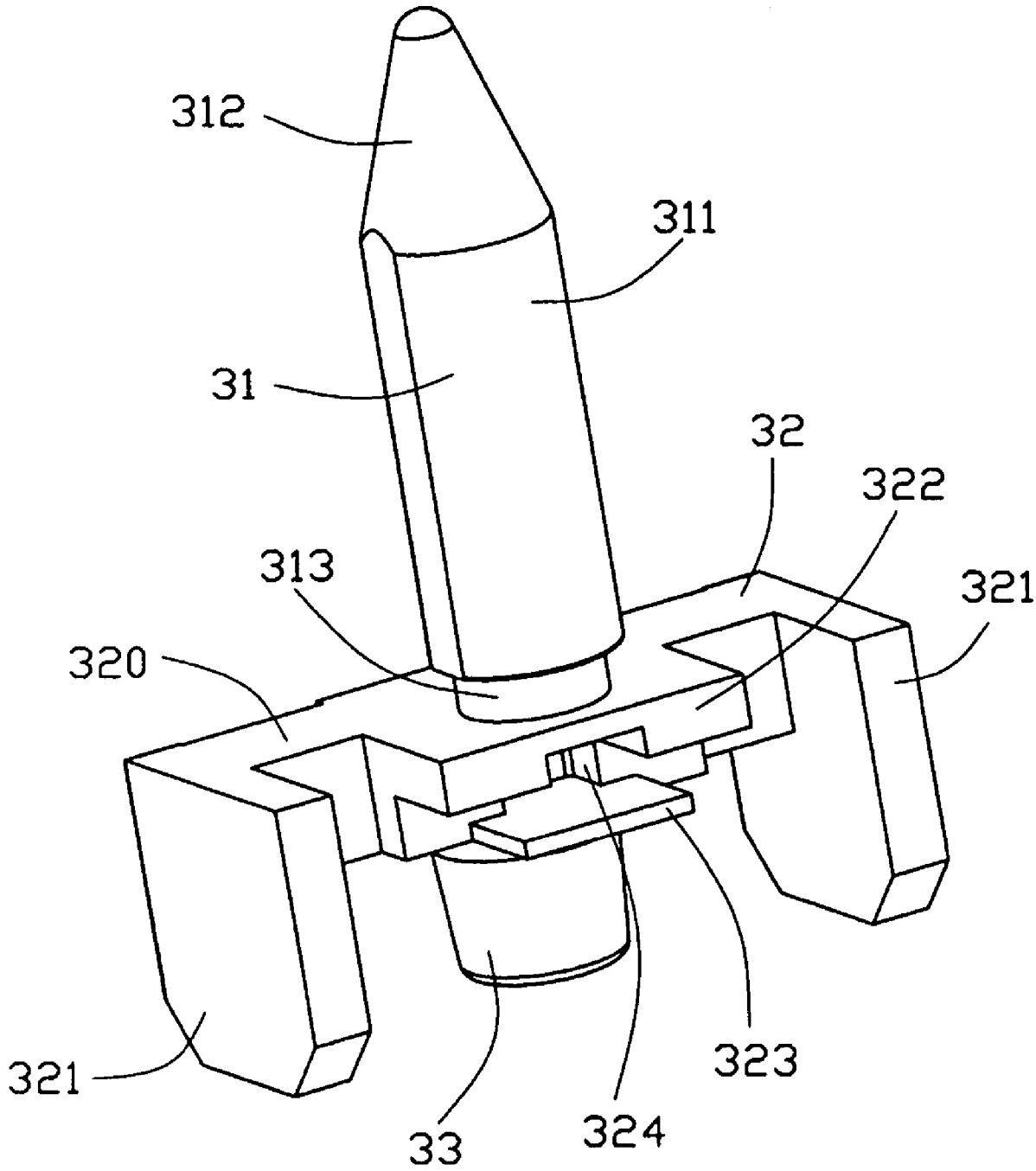
FIG. 2 is a perspective view of an actuator as shown in FIG. 1.

Referring to FIG. 2, the actuator 3 comprises a body portion 32 and a button 31 extending upwardly from a top of the body portion 32. The button 31 includes a columnar portion 311, and a guiding portion 312 having a conical shape for facilitating an insertion of itself into the through hole 26 during assembly. The button 31 defines therearound an annular groove 313, which is positioned adjacent to the body portion 32. The body portion 32 is provided with a rectangular primary wall 320, a pair of periphery walls 321 perpendicular to opposite sides of the primary wall 320, and a columnar post 33 extending downwardly from the primary wall 320 for fastening the spring 5. A nose portion 322 configured as a flat plane projects rearwardly from a center of an upper portion of the primary wall 320, and is flush with a top surface of the primary wall 320 for upholding the button 31. A slot 324 is defined at a bottom of the nose portion 322 in a longitudinal direction. The nose portion 322 has a tongue portion 323 extending parallel thereto and being located therebelow in a certain distance.

Figure 3:
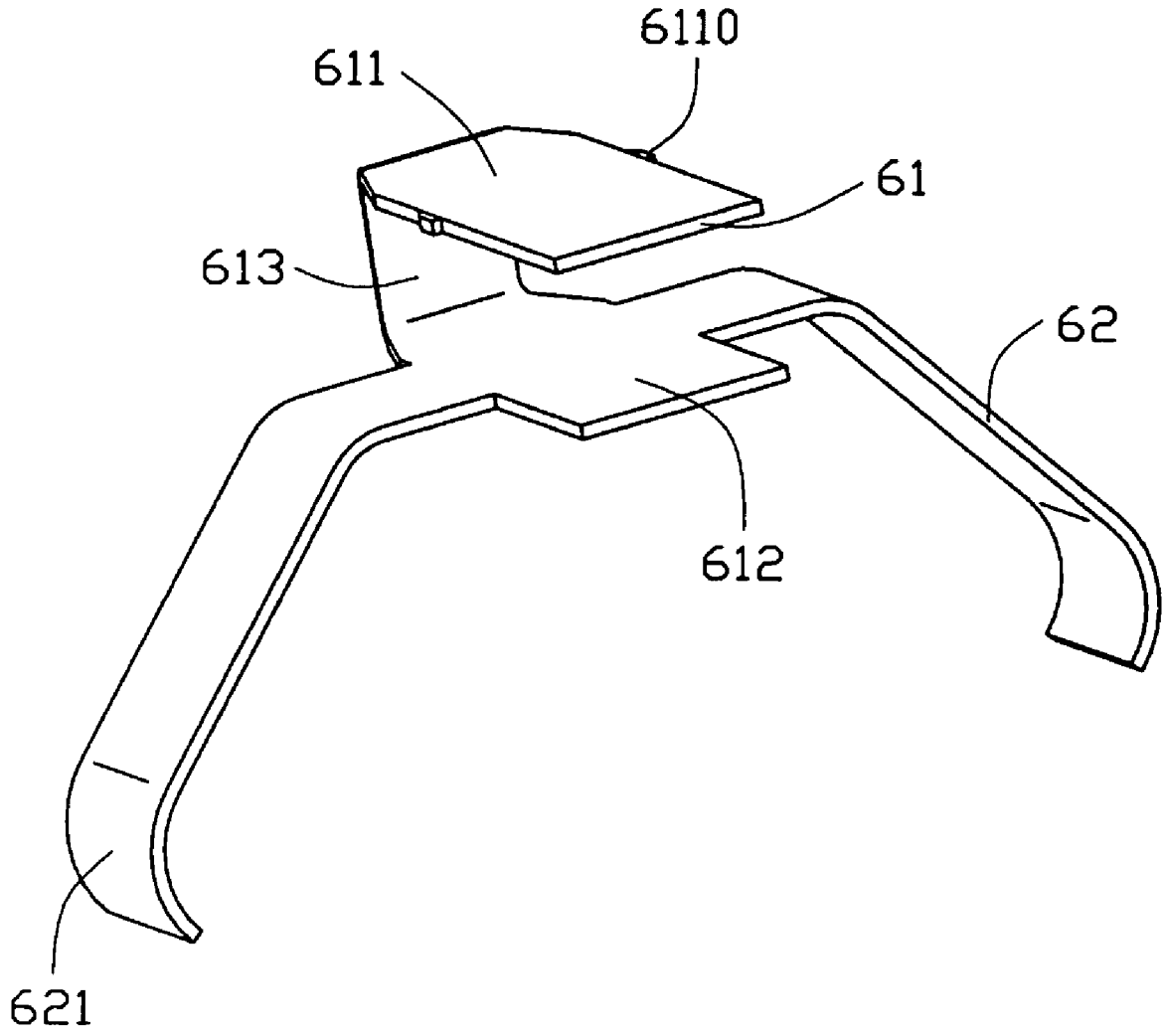
FIG. 3 is a perspective view of a moveable contact as shown in FIG. 1.

Referring to FIG. 3, the moveable contact 6 is formed by bending a punched metal plate, comprising a retention portion 61 and a pair of elastic beams 62. The retention portion 61 has an primary plate 612, an insertion plate 611 extending parallel to the primary plate 612 and positioned a certain distance above the primary plate 612. The insertion plate 611 has a pair of click projections 6110 formed at opposite edges thereof. A connection plate 613 extends in another direction perpendicular to the extending direction of the primary plate 612 for connecting the insertion plate 611 and primary plate 612 together. The pair of elastic beams 62 extend symmetrically horizontally firstly from a center of opposite sides of the primary plate 612 and then outspread obliquely downwardly. A contact portion 621 having a semi-circular curved surface is formed on a free end of each elastic beam 62.

Referring to FIG. 1, each fixed contact 7 comprises a body portion 71, a pair of soldering portions 74, and a pair of connection portions 72 connecting the corresponding soldering portions 74 to the body portion 71. The body portion 71 is configured as a lying "L", with one end thereof protruding laterally therefrom to form an engaging portion 711. The body portion 71 has an indentation 73 defined beside the engaging portion 711 thereof.

Figure 4:
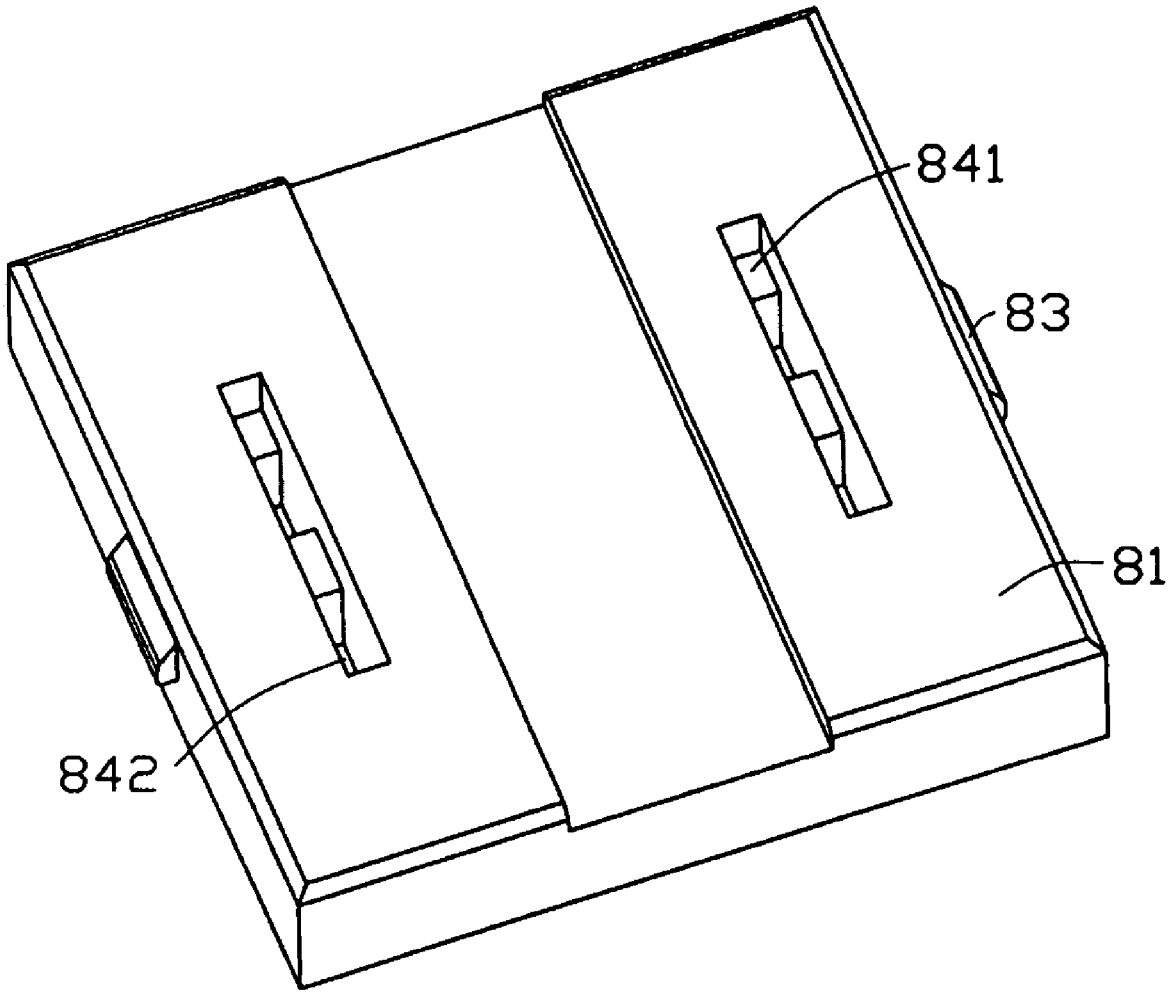
FIG. 4 is a perspective view of a base as shown in FIG. 1.

Referring to FIG. 4, in conjunction with FIG. 1, the base 8 is substantially a flat plane, comprising an inner face 81, an out face 82 and a pair of tubers 83 formed at opposite sides thereof. The inner wall 81 has a pair of retaining channels 841 symmetrically defined therein. The outer wall 82 defines therein two pairs of insertion channels 142 respectively communicating with corresponding retaining channel 841 for extension of the soldering portions 74 of the fixed contacts 7.

Figure 5:
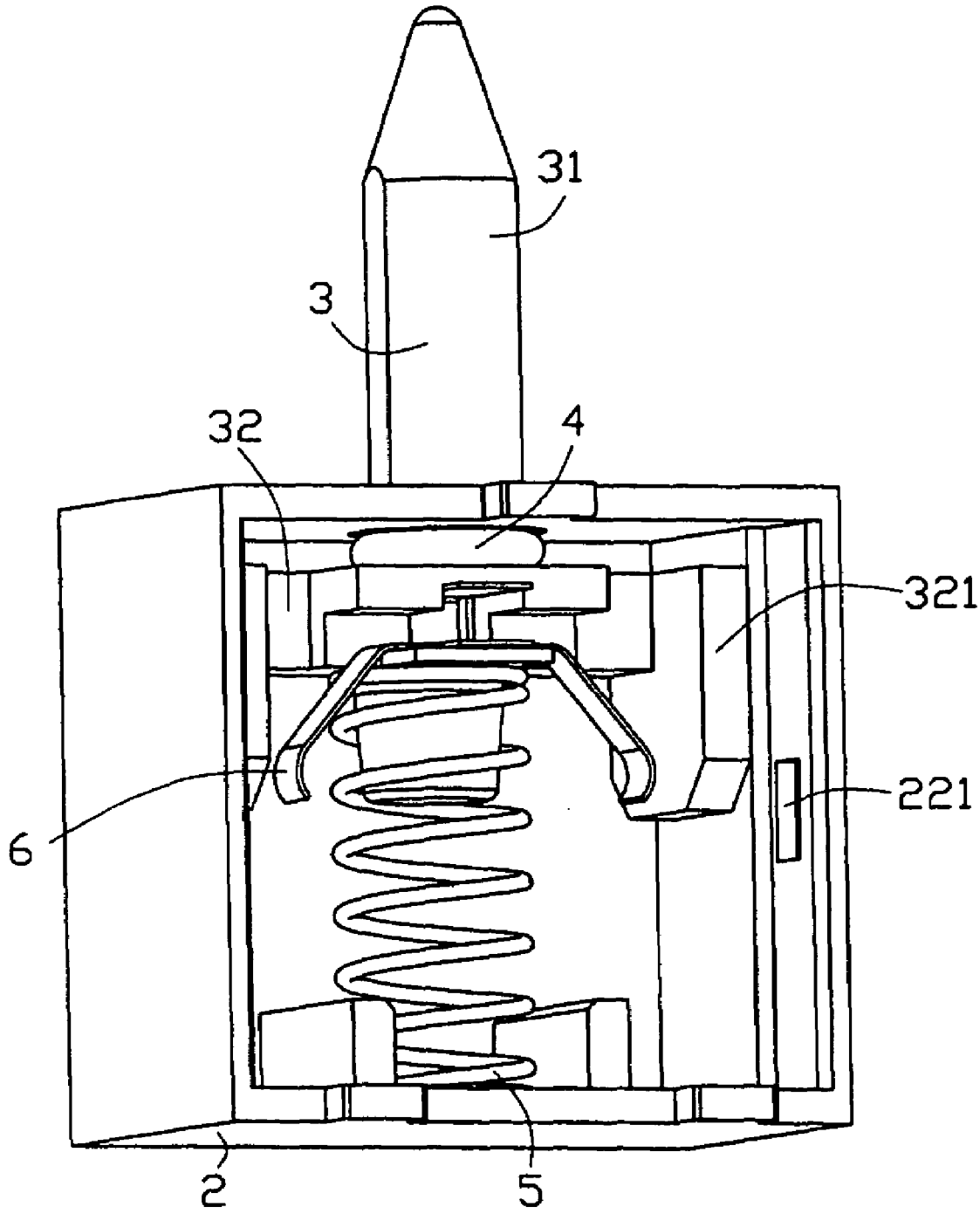
FIG. 5 is an assembled perspective view of the sealed pushbutton switch as shown in FIG. 1, with the base and fixed contacts being removed.
Figure 6:
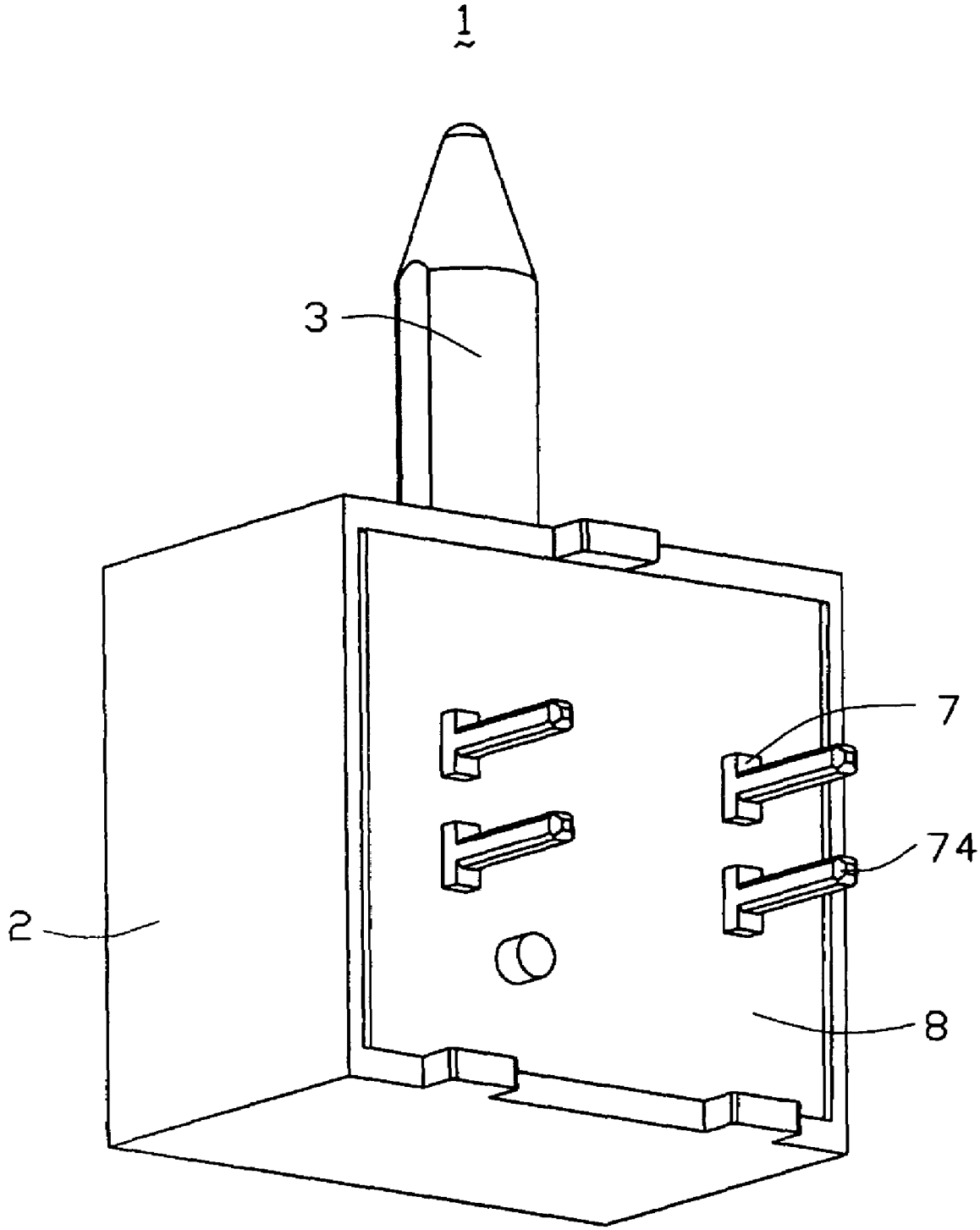
FIG. 6 is an assembled perspective view of the sealed pushbutton switch as shown in FIG. 1.
Figure 7:
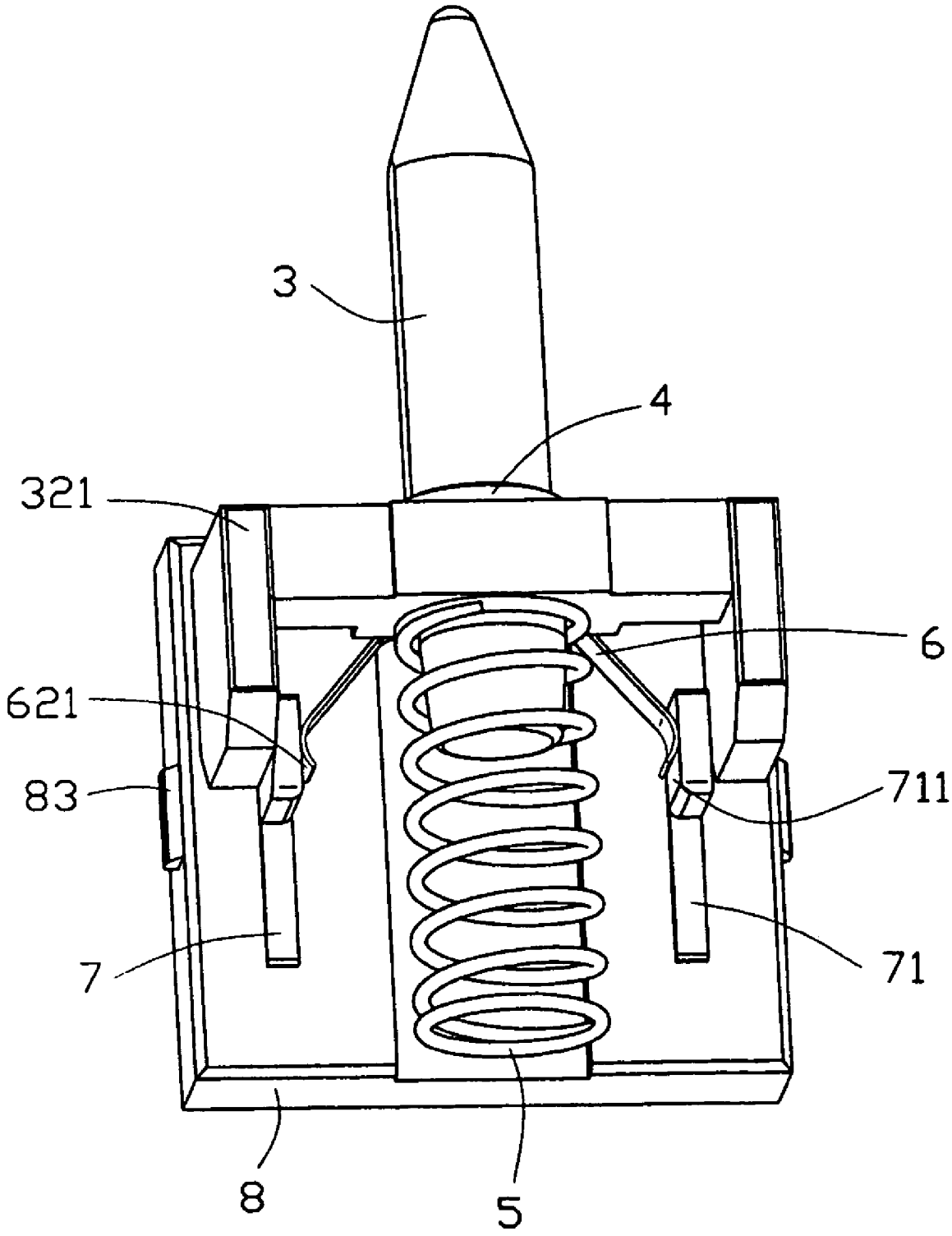
FIG. 7 is an assembled perspective view of the sealed pushbutton switch as shown in FIG. 1, with an insulative housing being removed.

Referring to FIGS. 5-7, in conjunction with FIG. 1, in assembly of the sealed pushbutton switch 1, the moveable contact 6 is fastened to the body portion 32 of the actuator 3 firstly. The retention portion 61 of the moveable contact 6 is confined between the nose portion 322 and the tongue portion 323 of the actuator 3, with the insertion plate 611 thereof being inserted into the slot 324 and the click projections 6110 thereof frictionally engaging with the slot 324. The pair of elastic beams 62 are positioned between the pair of periphery walls 321. The spring 5 is assembled to the actuator 3 by encircling around the post 33. Secondly, The actuator 3 together with the moveable contact 6 and the spring 5 are received in the cavity 25 of the insulative housing 2, with the button 31 extending outside the top wall 21 through the through hole 26. The washer 4 is then inserted into the annular groove 313 for preventing leaks between the actuator 3 and the insulative housing 2.

Thirdly, the pair of fixed contacts 7 are assembled to the base 8. The body portions 71 of the fixed contacts 7 are respectively partially retained in corresponding retaining channels 841, with engaging portions 711 thereof being exposed on the inner face 11, the connection portions 72 thereof inserted into the corresponding insertion channels 142, and the soldering portions 74 thereof extending outwardly through the insertion channels 142. Finally, the base 1 together with the fixed contacts 7 are attached to a rear portion of the insulative housing 2. Referring to FIGS. 5, 7, the spring 5 is located between the actuator 3 and the bottom wall 24 of the insulative housing 2, with a lower portion thereof fixed between the pair of protrusions 241. The pair of elastic beams 62 of the moveable contact 6 are positioned between the fixed contacts 7, with the contact portions 621 thereof respectively contacting with the corresponding engaging portions 711. An electrical connection between the fixed contacts 7 is established, via an engagement between the contact portions 621 and the engaging portions 711 of the fixed contacts 7. The sealed pushbutton switch 1 is in the closed position.

In operation, when the button 31 of the actuator 3 is downwardly pushed due to an external force exerted thereon, the moveable contact 6 is driven to move downwardly together with the actuator 3 to thereby make the contact portions 621 moving away from the engaging portions 711 and plunging into the indentations 73. The sealed pushbutton switch 1 is caused to be in an electrical opened position, when the electrical connection between the engaging portions 711 of the fixed contacts 7 is broken. At the same time, the spring 5 is compressed. When the external force is removed, the pushbutton switch 1 restores itself to a normally closed position, due to an elastic force provided by the compressed spring 5.

In another embodiment, the fixed contacts 7 could be assembled to the walls 21-24 of the insulative housing 2, with the engaging portions 711 thereof exposed to the cavity 25 for being contacted by the moveable contact 6.

However, the disclosure is illustrative only, changes may be made in detail, especially in matter of shape, size, and arrangement of parts within the principles of the invention.

What is claimed is:

1. A sealed pushbutton switch, comprising:

an insulative housing defining a cavity;

a plurality of fixed contacts symmetrically exposed beside opposite sides of the insulative housing;

an actuator moveably retained in the cavity of the insulative housing;

a moveable contact fastened to the actuator and symmetrically formed with a plurality of elastic beams extending toward opposite sides of the insulative housing, each elastic beam being provided with a contact portion contactable to corresponding fixed contacts;

a spring mounted below said actuator; and a base on which the fixed contacts are mounted, wherein said base together with the fixed contacts are attached to an opening of the insulative housing;

wherein when said actuator is pressed and moves together with said moveable contact from a first position to a second position relative to the insulative housing along a top-to-bottom direction, an electrical connection between said moveable contact and the fixed contacts comes to break;

wherein said base defines therein a plurality of retaining channels, and wherein each fixed contact has a body portion retained in corresponding retaining channel and provided with an engaging portion exposed on the base for engaging with corresponding contact portion of said moveable contact;

wherein said body portion of the fixed contact is L-shaped, and has an indentation defined beside the engaging portion for enclosing corresponding contact portion of the moveable contact, when the moveable contact is in the second position.

2. The sealed pushbutton switch as claimed in claim 1, wherein each fixed contact comprises a plurality of soldering portions extending outside the base, and a plurality of connection portions connecting corresponding soldering portions to the body portion, and wherein said base defines a plurality of insertion channels communicating with corresponding retaining channels for insertion of said connection portions of the fixed contacts.

3. A sealed pushbutton switch, comprising:

an insulative housing defining a cavity;

a plurality of fixed contacts each defining a mounting leg extending in a first direction;

an actuator moveably having a portion retained in the cavity of the insulative housing;

a moveable contact mounted upon said portion of the actuator and comprising a plurality of elastic beams each provided with a contact portion contactable to corresponding fixed contacts; and a spring mounted behind said actuator; wherein when said actuator is pressed and moves together with said moveable contact from a first position to a second position relative to the insulative housing along second direction perpendicular to the first direction, an electrical connection between said moveable contact and the fixed contacts changes under a condition that the contact portion exerts forces upon the corresponding fixed contact in a third direction perpendicular to both the first and second direction for not affecting the actuator and the mounting legs; wherein said moveable contact comprises a retention portion and a pair of obliquely outspreading elastic beams; wherein said retention portion of the moveable contact has a primary plate, and insertion plate extending parallel to the primary plate, and a connection plate vertically connecting the two plates together.

4. A sealed pushbutton switch, comprising:

an insulative housing defining a cavity;

a base attached to the insulative housing;

a plurality of fixed contacts mounted on the base;

an actuator moveably retained in the cavity of the insulative housing;

a moveable contact fastened to the actuator and comprising a plurality of outspreading elastic beams each provided with a contact portion contactable to corresponding fixed contacts, and a retention portion having a primary plate, an insertion plate extending parallel to the primary plate, and a connection plate vertically connecting the two plates together; and a spring mounted below said actuator;

wherein when said actuator is pressed and moves together with said moveable contact from a first position to a second position relative to the insulative housing along a top-to-bottom direction, an electrical connection between said moveable contact and the fixed contacts comes to break.

* * * * *